United States Patent [19]

Cook

[11] 4,268,983

[45] May 26, 1981

[54] SECURITY LABEL

[75] Inventor: Jack E. Cook, Saint Paul, Minn.

[73] Assignee: Minnesota Mining and Manufacturing Company, St. Paul, Minn.

[21] Appl. No.: 973,734

[22] Filed: Dec. 26, 1978

[51] Int. Cl.[3] ..... G09F 3/02

[52] U.S. Cl. ..... 40/2.2; 283/18; 283/21; 283/8 R

[58] Field of Search ..... 283/8 R, 9 R, 10, 18, 283/21, 22; 40/2.2, 2 R, 2 B

[56] References Cited

U.S. PATENT DOCUMENTS

| | | | |
|---|---|---|---|
| Re. 24,906 | 12/1960 | Ulrich | 206/59 |
| 127,603 | 6/1872 | Walker | 40/2 X |
| 444,344 | 1/1891 | Fletcher | 40/2 B |
| 1,003,443 | 9/1911 | Erickson | 40/2 B X |
| 1,825,796 | 10/1931 | Himmell | 40/2.2 X |
| 1,898,993 | 2/1933 | Meyercord | 40/2 B X |
| 2,407,680 | 9/1946 | Palmquist | 40/615 X |
| 2,604,710 | 7/1952 | Beaune | 40/2.2 |
| 2,768,460 | 10/1956 | Northrup | 40/2 R |
| 2,969,300 | 1/1961 | Franz | 156/261 |
| 3,034,430 | 5/1962 | Bradford | 101/369 |
| 3,152,950 | 10/1964 | Palmquist | 161/214 |
| 3,315,386 | 4/1967 | Kest et al. | 40/2 R |
| 3,616,026 | 10/1971 | Larsen | 156/234 |
| 3,637,294 | 1/1972 | Berthold | 350/166 |
| 3,658,616 | 4/1972 | Dreyer | 156/234 |
| 3,700,305 | 10/1972 | Bingham | 350/105 |
| 3,801,183 | 4/1974 | Sevelin | 350/105 |
| 3,864,855 | 2/1975 | Pekko et al. | 40/2 R |
| 3,889,407 | 6/1975 | Elzer | 40/2 R |
| 3,925,584 | 12/1975 | Suzuki et al. | 428/40 |
| 4,070,774 | 1/1978 | Staats et al. | 40/2.2 |
| 4,082,873 | 4/1978 | Williams | 428/40 |
| 4,099,838 | 7/1978 | Cook et al. | 350/105 |
| 4,180,929 | 1/1980 | Schultz | 40/2.2 |

OTHER PUBLICATIONS

Physics of Thin Films, vol. VIII, published by Academic Press in 1975.

*Primary Examiner*—Gene Mancene
*Assistant Examiner*—Wenceslao J. Contreras
*Attorney, Agent, or Firm*—Cruzan Alexander; Donald M. Sell; Roger R. Tamte

[57] ABSTRACT

Printable or otherwise encodable labels are provided with features that allow an observer to judge the validity of a marking made with the label. The labels comprise a handleable support sheet and a fragile easily tearable heat-softenable film adhered to the support sheet. A visible or machine-sensible component, such as a printed image, extends over the area of the film, and the film extends beyond at least one edge of the support sheet and carries a layer of adhesive so that it can be adhered to an article that is to be marked. Upon removal of the label from an article to which it has been applied as a marking, the extending portion of the film will tear and remain adhered to the article. The removed label will not be useful if applied to another article with a portion missing; and if an attempt is made to superpose the label with the torn portion of film remaining on a different article, mismatching of the label and torn portion, e.g., through mismatching of the visible or machine-sensible component, will reveal the transfer.

12 Claims, 7 Drawing Figures

SECURITY LABEL

This invention provides a new kind of label that may be encoded with information and applied to an article as a marking that later purchasers, recipients, or other interested parties can use not only to receive the information encoded onto the label, but also to judge the origin or authenticity of the article.

An example of the need for labels of the invention occurs in the automobile part industry, which is permeated by trade in parts removed from stolen automobiles. To effectively combat this trade it is desired to mark the parts of new automobiles with labels that carry identifying information and are capable of resisting attempts to avoid or violate the marking system, such as by transferring labels among parts, or by counterfeiting labels.

Labels of the invention can resist even sophisticated efforts to defeat a marking system, because of structure that offers a unique combination of transfer-inhibiting, and preferably counterfeit-inhibiting, features. Briefly, a label of the invention comprises a handleable support sheet and a fragile easily tearable heat-softenable film adhered to the support sheet. The film includes a sensible background component, i.e., a visible or machine-sensible component such as a printed image, extending over its area; and a portion of the film extends beyond at least one edge of the support sheet, preferably an interior edge that defines an interior opening in the support sheet. The extending portion of film carries a layer of adhesive by which it may be adhered to an article that is to be marked.

If a label of the invention is removed from an article to which it has been applied, the extending portion of fragile film will tear from the rest of the film and remain adhered to the article. Tearing of a portion of the label is a first line of defense against reuse of the label, since application of the label with a portion missing would reveal the transfer.

Preferred labels of the invention, in which the visible or machine-sensible component is in the form of a pattern of graphic images, offer a second line of defense, namely a defense against attempts to superpose a label removed from one article with a residue of torn film on a different article. When the fragile film carries an image as described, superpositioning will be revealed, since statistically it is unlikely that the image on the label will have been torn at the same place as the image on the residue of film. Additional protection against such attempts at superpositioning labels and film residues can be provided with labels of the invention that have a plurality of openings spaced apart different amounts from label to label.

The most preferred labels of the invention offer a third line of defense, namely a defense against attempts to counterfeit them, which is achieved by forming the images in the fragile film as "latent" retroreflective images, which require sophisticated technology to prepare. By "latent" retroreflective image, it is meant an image that is not generally visible under diffused-light viewing conditions. In diffused-light viewing conditions, such as ordinary daylight or in a lighted room, light striking the label is diffused ambient light; while in retroreflective viewing conditions, light is beamed at the label and an observer views the label from a position substantially coaxial with the beam of light.

A variety of ways to provide latent retroreflective images for use in authenticating documents are taught in Sevelin et al, U.S. Pat. No. 3,801,183, and Cook et al, U.S. Pat. No. 4,099,838, which are incorporated herein by reference. The preferred way is by use of an image-bearing dielectric mirror disposed behind a layer of microspheres. As generally described in Bingham, U.S. Pat. No. 3,700,305, which is also incorporated herein by reference, a dielectric mirror comprises a transparent layer of refractive index $n_1$, the faces of which are in contact with materials of refractive indices $n_2$ and $n_3$; both $n_2$ and $n_3$ being at least 0.1 (preferably at least 0.3) either higher or lower than $n_1$; and the transparent layer having an optical thickness (the multiplication product of physical thickness and index of refraction) corresponding to odd-numbered multiples (i.e., 1, 3, 5, 7, . . .) of about one-fourth wavelength of light in the wavelength range of about 3800 to about 10,000 angstroms. Stated another way, the mirror comprises a contiguous array of materials, at least one of which is in layer form with an optical thickness as described, and the contiguous materials of the array alternate between higher and lower refractive index. Reflection occurs by phase agreement or enhancement of the light reflected at the interfaces of the one or more thin transparent layers of the described optical thickness. Dielectric layers of the appropriate thickness may be formed by vapor-deposition techniques.

Latent images can be built into a dielectric mirror behind a layer of microspheres, as taught by the noted Sevelin et al and Cook et al patents, by printing at least one substantially transparent layer in an imagewise pattern between the microspheres and the transparent dielectric layer furthermost from the microspheres. The array of dielectric and print layers form a dielectric mirror in which the image and background areas have different reflective efficiencies. This difference arises because there is a different number of layers in the image area than in the background areas, and also, if the printed image is disposed between two thin dielectric layers, because there is a greater contrast in index of refraction between the contiguous dielectric layers in the background areas than between any of the contiguous layers in the image areas.

Although a patterned dielectric mirror is greatly preferred as the sensible background component in the fragile film, many other techniques can be used, including printing of images from a visible or machine-sensible ink (i.e., magnetic ink, which may be covered with an opaque camouflage layer); or incorporation of a nonimaging component such as a dispersion of colored pigment, metal flake, magnetic particles, etc. into the film, or into a coating in the film. The more distinctive the sensible background information, the more difficult will it be to counterfeit the label.

The art has long provided transfer-resistant labels; see Walker, U.S. Pat. No. 127,663, issued in 1872 for an adhesive label having printed matter on its adhesive side so that the label could not be removed without defacing that printed matter. A variety of other means to make a label difficult to transfer or counterfeit have been developed, as illustrated by such patents as Erickson, U.S. Pat. No. 1,003,443 (a label comprising two overlaid films each of which carries a portion of a complete design; removal of one film reveals transfer); Himmell, U.S. Pat. No. 1,825,796 (special printable papers made with an identifying marking that is visible only with transmitted light); Pekko et al, U.S. Pat. No. 3,864,855 (tamper-proof label comprising a fragile label base and a protective overlay film which is removed after application of the label, leaving just the difficult-to-transfer label base); Suzuki et al, U.S. Pat. No. 3,925,584 (sealing tape comprising a thin-leaf fragile material which carries on one surface a strong adhesive layer by which the tape is adhered to an article and on its other surface a weak adhesive layer by which a support sheet is weakly adhered to the assembly); and Williams, U.S. Pat. No. 4,082,873 (laminated label comprising a transparent film having printing on its reverse side and an adhesive layer to which the printing adheres more strongly than it adheres to the transparent film).

However, none of these prior-art approaches, nor any other known approach, provides the combination of features exhibited by a label of the present invention, which provide strongly effective defenses against even sophisticated attempts to transfer or counterfeit the label.

Figure 1:
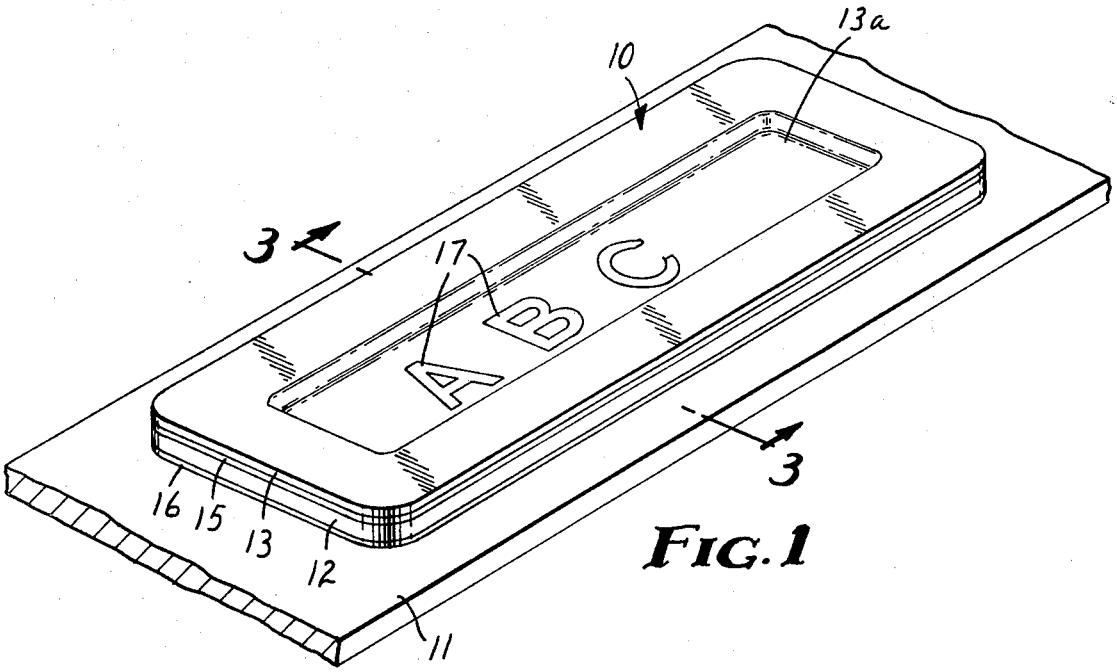
FIGS. 1 and 6 are perspective views of illustrative labels of the invention.

In the perspective and sectional views of the drawings, the thicknesses are not necessarily in scale with the rest of the drawing.

DETAILED DESCRIPTION

FIG. 1 shows a label of the invention 10 carried on a liner 11 to which the label is releasably adhered. The label 10 comprises a handleable support sheet 12 and a fragile, easily tearable film 13 adhered to the support sheet. The support sheet 12 has a central rectangular opening 14, and a portion 13*a* of the film 13 drapes downwardly into this opening. The film 13 carries a layer of adhesive 15 by which it is adhered to the support sheet; and in the opening 14 of the support sheet the adhesive 15 may weakly adhere the portion 13*a* of the film to the release liner 11. The support sheet 12 also carries a layer of adhesive 16 by which it is weakly adhered to the release liner. A wide variety of release liners may be used and typically comprise a backing, such as of paper or polymeric film, treated with release agent such as silicone-based release material.

The label 10 is shown in FIG. 1 with alphanumeric characters 17, e.g., "A," "B," and "C," representing the kind of coded information that might be applied to the label. Such information would most typically be applied to the label by a printing operation while the label was carried on the release liner. For example, a person who wished to mark an article might type onto the label desired identifying information. Or, in larger-scale uses, a plurality of labels would be adhered along the surface of the release liner, and machine-controlled printing operations would be used. Printing may be applied onto other portions of a label than the portion of the fragile film extending beyond an edge of the support sheet, and also may be applied onto a top film adhered to a portion of the label, if the top film is adhered to the rest of the label sufficiently as to cause destruction of the label by attempted removal of the top film.

Figure 2:
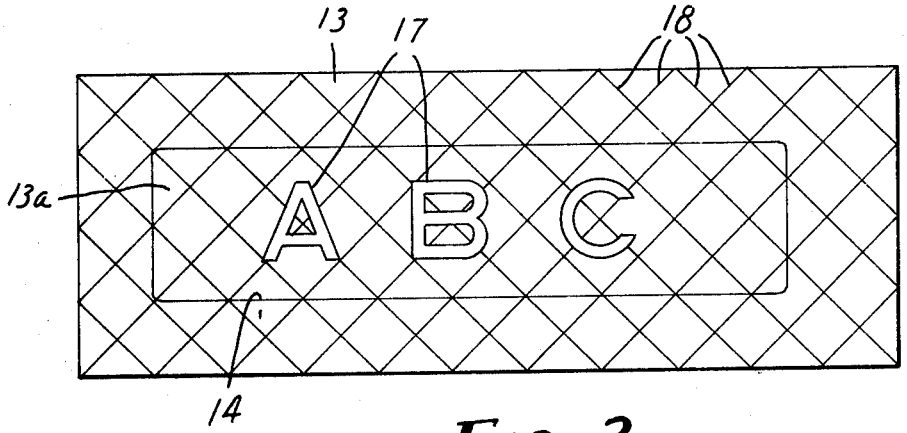
FIG. 2 is a plan view of a label of the type pictured in FIG. 1 shown as it would appear in one embodiment under retroreflective illumination.

In addition to the visible characters A, B, C, the illustrative label 10 carries a pattern of latent retroreflective background images extending over the area of the film. As shown in FIG. 2, which represents the appearance of the label 10 under retroreflective viewing conditions, one possible pattern comprises crosshatched lines 18 which extend over the area of the film.

Figure 4:
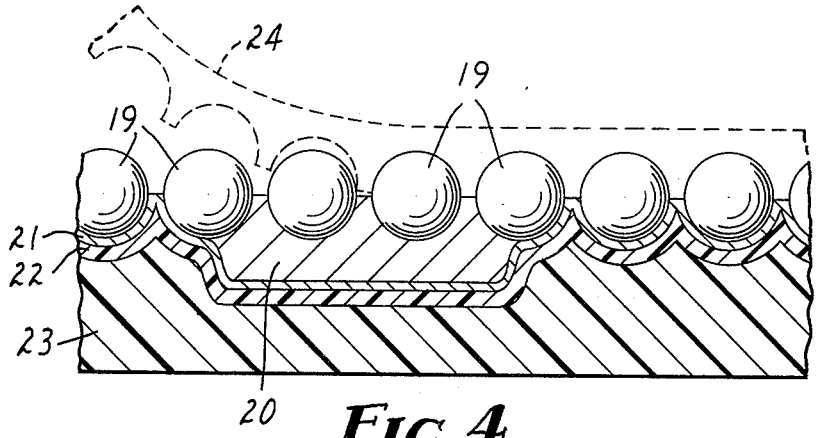
FIG. 4 is an enlarged sectional view of a portion of the label shown in FIG. 1, with a carrier film used in construction of a portion of the label.

The sectional view of the film 13 in FIG. 4 shows a preferred imaged dielectric mirror useful in labels of the invention. As illustrated in FIG. 4, the film 13 comprises a monolayer of transparent microspheres 19, a dielectric mirror comprising a transparent image layer 20 printed in the desired image pattern (i.e., to form the images 18), and a thin transparent layer 21 of dielectric material of appropriate refractive index and optical thickness coated onto the microspheres 19 and image layer; a barrier layer 22; and a layer of adhesive 23. The barrier layer 22 is desirable in construction in which the adhesive 23 is a pressure-sensitive adhesive to keep the adhesive from oozing up around the microspheres, picking up lint, etc. The barrier layer should be quite thin, e.g., about 15 micrometers, so as to avoid unduly strengthening the overall film 13.

A film 13 of the type shown in FIG. 4 is generally formed (see the noted Sevelin et al or Cook et al patents) by embedding the microspheres as a monolayer in a removable carrier film 24, then printing the image layer 20 with a transparent ink, then vapor-deposition the transparent dielectric layer 21, and then coating the barrier layer 22 and adhesive layer 23, as from solution. The carrier film 24 is generally pulled away after the film 13 has been laminated to the support sheet 12, and is included in FIG. 4 in dotted lines only for the purpose of illustrating its location during construction of the film 13.

The film 13 is fragile and easily tearable, i.e., the barrier layer, if included, is very thin, and the adhesive layer is thin and usually of little tensile or cohesive strength. Fragility can also be achieved by weakening the film as with perforations, etc. In general, the cohesive strength of the film 13 should be less than the adhesive strength of the adhesive layer 23 against intended substrates.

The film 13 also softens upon application of heat, since the ingredients are thermoplastic in nature. The result is that if an attempt is made to loosen the complete label 10 from a substrate by heat, the extending portions 13*a* of the film will shrivel or otherwise deform to reveal the attempted transfer. Application of solvent will also damage the extending portions 13*a* of the film 13.

In contrast to the film 13, the support sheet 12 is a handleable material, i.e., it can be lifted off the release liner conveniently and intact, and carried to an article where the label is to be applied. Suitable materials for such a support sheet include paper stock, polymeric films, metal sheets, etc.

Figure 3:
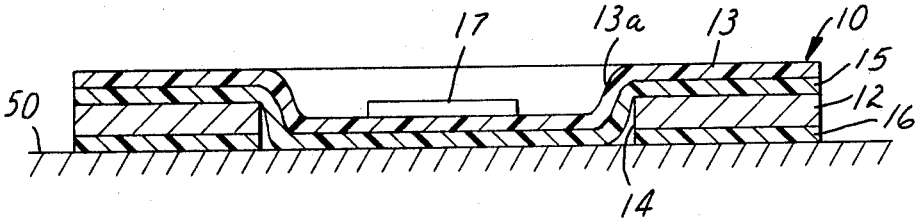
FIG. 3 is a sectional view along the lines 3—3 in FIG. 1.

A label 10 as shown in FIG. 1 functions in the following manner: Because the support sheet 12 (and the extending portion 13*a* of the film in the central aperture 14 of the support sheet) are only weakly adhered to the release liner 11, the label 10 can be removed intact from the liner and adhered to a substrate, such as the substrate 50 in FIG. 3. In adhering the label to the substrate 50, the support sheet 12, and the extending portion 13*a* of the film in the centrally apertured area 14 of the support sheet, are firmly pressed against the substrate. If an attempt is subsequently made to remove the label 10 from the substrate to which it has been adhered, the extending portion 13*a* of the film adhered to the substrate will remain adhered to the substrate.

Figure 5:
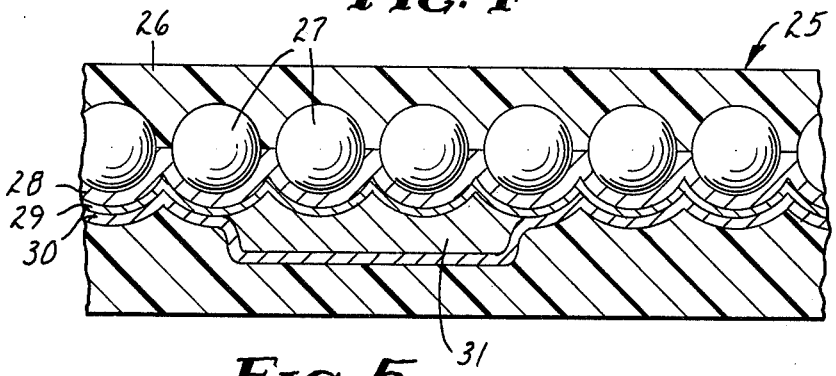
FIG. 5 is an enlarged sectional view like FIG. 4, but of a different label of the invention.

FIG. 5 shows a different embodiment of fragile film 25 useful in labels of the invention, and the film incorporates a different kind of dielectric mirror. The film 25 includes a transparent top layer 26 as a permanent part of the film. The covering of the microspheres 27 by the top layer 26 means that the film will rtroreflect whether wet or dry, which can be useful for labels that may be used out of doors. The layer 26 alters the path of light rays through the film, and in accordance with the principles taught in Palmquist et al, U.S. Pat. No. 2,407,680, a film such as the film 25 may include a spacing layer 28 (the presence and thickness of the layer depends on the relative indices of refraction of the microspheres 27 and top layer 26) to position a specularly reflective layer at the approximate focal area for light rays passing through the microspheres 27. In this case the specularly reflective layer is an imaged dielectric mirror comprising first and second transparent dielectric layers 29 and 30 and image layer 31. Two contiguous dielectric layers of different indices of refraction can produce a brighter reflection than the single dielectric layer of FIG. 4. In film such as the film 25, the top layer 26 should be thin and/or of low tensile strength to maintain the fragility of the film.

In a further variation of imaged dielectric mirrors taught in Cook et al, U.S. Pat. No. 4,099,838, useful in fragile films in labels of the invention, the background and image areas of the dielectric mirror are "tuned" to reflect light from different portions of the wavelength spectrum of visible light. That is, the background and image area portions of the dielectric mirror have different effective optical thicknesses and therefore will reflect, through phase agreement or enhancement, different wavelengths of light. Since the different wavelengths of light carry a different coloration, the color of the reflection in the background areas will be different from the color of the reflection in the image areas.

Figure 6:
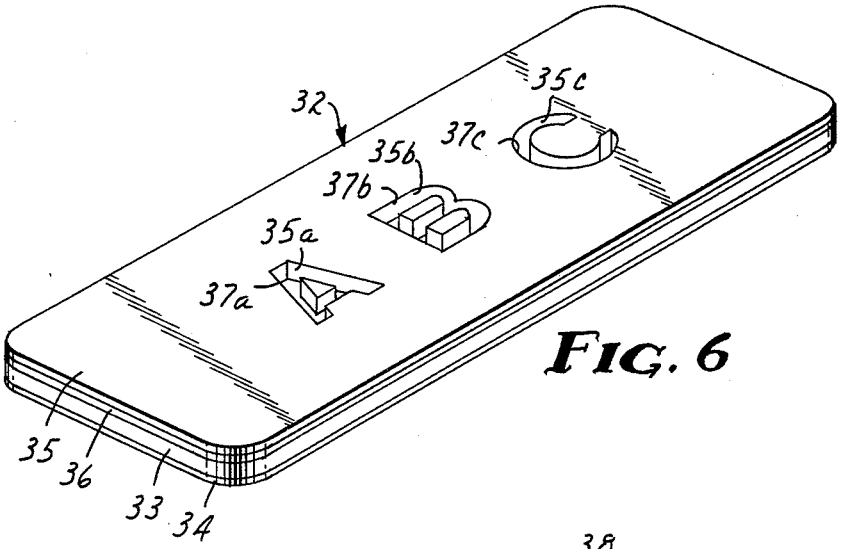

FIG. 6 shows a different label of the invention 32 comprising a support sheet 33, which may carry a layer of adhesive 34 to adhere the label to a substrate, and a fragile film 35 adhered to the support by a layer of adhesive 36. The support sheet 33 is formed with openings 37*a*, 37*b*, 37*c*, . . . , shaped to provide identifying information. Extending portions 35*a*, 35*b*, 35*c*, . . . of the film 35 drape into the openings 37*a*, 37*b*, 37*c*, . . . of the support sheet to become adhered to a substrate to which the label is applied. Upon attempted removal of the label, the extending portions 35*a* of the fragile film 35 will be torn at the openings 37*a*, 37*b*, 37*c*, . . . and remain adhered to the subtrate.

Figure 7:
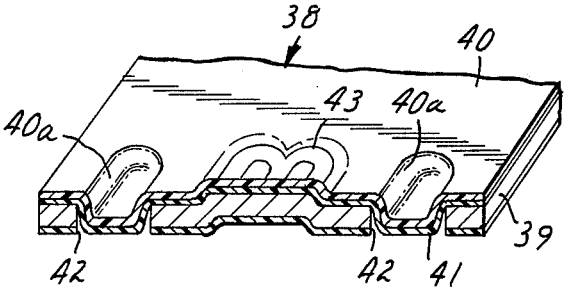
FIG. 7 is a partial perspective view in section of a different label of the invention.

FIG. 7 illustrates a different label of the invention 38 comprising a support sheet 39 and fragile film 40 adhered to the support sheet by a layer of adhesive 41. The support sheet is perforated with a plurality of openings 42 into which portions 40*a* of the fragile film extend. Identifying information is encoded into this illustrative label by embossing alphanumeric characters 43, both the support sheet and fragile film being embossed.

Labels of the invention in which the fragile film extends into an interior opening of the support sheet, i.e., an opening in which at least a portion of the opening is inward of the outer boundary of the support sheet (including notches extending into the edge of the support sheet) are preferred, because they offer improved resistance against superposing a label from one article with the residue of film on a different article.

Many adhesives are useful in labels of the invention. Pressure-sensitive adhesives are particularly useful for both the support sheet and overlay film and preferably are of the acrylate variety taught in Ulrich, U.S. Pat. No. Re. 24,906. Rubber-resin pressure-sensitive adhesives are also useful. In addition, the adhesives can be heat- or solvent-activated.

If a barrier layer is included in the fragile film, it can be formed of many different polymers such as an alkyd or acrylic resin. Such polymers can also be used for top layers and spacing layers.

Labels of the invention can be printed upon by conventional typing or printing operations. With films such as the film 13 shown in FIGS. 1–4, the ink used should penetrate between the microspheres and into the binder or adhesive layer under the microspheres. Commercially available ink, films, or ribbons such as Columbia Ribbon and Carbon Manufacturing Company's Mara-Tec 7000 ink on film or No. 51 or No. 52 black ink on ribbon are some examples.

The invention will be further illustrated by the following example.

A fragile film having a latent retroreflective image was prepared by first partially embedding a monolayer of glass microspheres into a polyethylene coating on a carrier web. The microspheres had a refractive index of 1.93 and diameters of about 50 micrometers, and were embedded to about 40 percent of their diameters. A pattern of images was then printed on the exposed microsphere surface of the web using an offset flexographic printing unit and an alkyd lithographic varnish having a refractive index of about 1.5. After the printed varnish had dried, the web was vapor-coated with an approximately 600-angstrom thickness of zinc sulfide, which has a refractive index of 2.37. A barrier layer was then applied by coating a 32-weight-percent-solids solution comprising a short-oil coconut alkyd, a short-oil castor alkyd, and a butylated melamine formaldehyde curing agent using a coating bar with a 0.005-centimeter slot, and then drying and curing the coating in a draft oven over a 34-minute period in which the oven temperature was started at 43° C. and elevated to 130° C. Lastly, a layer of a pressure-sensitive adhesive copolymer of isooctyl acrylate and acrylic acid was solvent-coated onto the barrier layer and allowed to dry at room temperature for about 16 hours, leaving a dry coating about 50 micrometers thick.

This film was then laminated by means of the dry adhesive layer to paper label stock, which itself carried a layer of the same pressure-sensitive adhesive covered by a silicone-coated release liner. The individual labels were 2.5 by 7.5 centimeters and had a 1.2-by-5.5-centimeter opening in the center.

What is claimed is:

1. Transfer-inhibiting label comprising a handleable support sheet and a fragile easily tearable heat-softenable film adhered to the support sheet; said film having a sensible component extending over the area of the film, and a portion of the film extending beyond at least one edge of the support sheet and carrying an adhesive layer by which the extending portion may be adhered to an article to which the label is applied, whereby the extending portion will tear from the rest of the film and remain adhered to the article upon removal of the label from the article.

2. A label of claim 1 in which said edge of the support sheet defines an interior opening in the support sheet, and the extending portion of the fragile film spans said opening.

3. A label of claim 2 in which said support sheet has a plurality of interior openings shaped as alphanumeric characters.

4. A set of labels as described in claim 2 in which said support sheet has a plurality of openings, and the pattern of openings in at least one label is different from the pattern of openings in at least one other label in the set.

5. A label of claim 1 in which said sensible component extends over the area of the film in an imagewise pattern.

6. A label of claim 1 in which said component comprises a latent retroreflective image.

7. A label of claim 6 in which said sensible component comprises an imaged dielectric mirror that forms said latent retroreflective image.

8. Transfer-inhibiting label comprising a handleable support sheet that has at least one interior opening and a fragile easily tearable heat-softenable film adhered to the support sheet and spanning at least a portion of said interior opening; said film having a sensible component extending over the area of the film in an imagewise pattern, and the portion of the film that spans said opening carrying an adhesive layer by which the portion may be adhered to an article to which the label is applied, whereby the portion will tear from the rest of the film and remain adhered to the article upon removal of the label from the article.

9. A label of claim 8 in which said sensible component comprises a latent retroreflective image.

10. A label of claim 9 in which the sensible component comprises an imaged dielectric mirror that forms said latent retroreflective image.

11. Tranfer-inhibiting label comprising a handleable support sheet and a fragile easily tearable heat-softenable film adhered to the support sheet; said film comprising a monolayer of glass microspheres and an imaged dielectric mirror underlying the microspheres so as to provide the film with a latent retroreflective image, and a portion of the fragile film extending beyond at least one edge of the support sheet and carrying an adhesive layer by which the extending portion may be adhered to an article to which the label is applied, whereby the portion will tear from the rest of the label and remain adhered to the article upon removal of the label from the article.

12. A label of claim 11 in which said edge of the support sheet defines an interior opening in the support sheet, and the extending portion of the fragile film spans said opening.

* * * * *